US009327740B2

(12) United States Patent
Murren et al.

(10) Patent No.: US 9,327,740 B2
(45) Date of Patent: May 3, 2016

(54) METHOD AND SYSTEM FOR COMMUNICATING DATA WITH VEHICLES

(71) Applicants: Brian Terence Murren, Melbourne, FL (US); Daniel Keith Pagano, Melbourne, FL (US); Samuel William Golden, Melbourne, FL (US); Brian Smith, Melbourne, FL (US); Jared Klineman Cooper, Melbourne, FL (US)

(72) Inventors: Brian Terence Murren, Melbourne, FL (US); Daniel Keith Pagano, Melbourne, FL (US); Samuel William Golden, Melbourne, FL (US); Brian Smith, Melbourne, FL (US); Jared Klineman Cooper, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/525,252

(22) Filed: Oct. 28, 2014

(65) Prior Publication Data

US 2016/0031459 A1 Feb. 4, 2016

Related U.S. Application Data

(60) Provisional application No. 62/031,267, filed on Jul. 31, 2014.

(51) Int. Cl.
*B61L 15/00* (2006.01)
*G08G 1/00* (2006.01)

(52) U.S. Cl.
CPC ..... *B61L 15/0018* (2013.01); *B61L 15/0072* (2013.01)

(58) Field of Classification Search
CPC ... B61L 15/0018; B61L 15/0072; B61L 3/20; B61L 3/18; G08G 1/207
USPC ..... 701/19, 20, 50, 22, 2; 246/186, 167 R, 246/198 A, 187 R, 62
See application file for complete search history.

(56) References Cited

U.S. PATENT DOCUMENTS 6,459,965 B1 10/2002 Polivka et al.
6,597,906 B1 7/2003 Van Leeuwen et al.
6,721,572 B1 4/2004 Smith et al.
6,799,100 B2 * 9/2004 Burns ..... G08G 1/207 340/436
6,885,854 B2 4/2005 Stewart (Continued)

OTHER PUBLICATIONS

PCT Search Report and Written Opinion issued in connection with corresponding Application No. PCT/US2015/042264 on Oct. 30, 2015.

*Primary Examiner* — Tan Q Nguyen
(74) *Attorney, Agent, or Firm* — GE Global Patent Operation; John A. Kramer

(57) ABSTRACT

A method includes defining a pre-load zone that has reliable communication along a route. The pre-load zone is associated with a trip of a vehicle traveling along the route. A starting location of the trip is located outside of the pre-load zone. The vehicle is configured to enter the pre-load zone and exit the pre-load zone prior to reaching the starting location of the trip. The method includes receiving a trip request message that identifies the pre-load zone from the vehicle after the vehicle enters the pre-load zone and prior to the vehicle exiting the pre-load zone. The method also includes sending a trip response message to the vehicle that the vehicle receives prior to exiting the pre-load zone. The trip response message includes trip data specific to the trip that is selected based on the association between the pre-load zone and the trip.

20 Claims, 10 Drawing Sheets

(56) References Cited

U.S. PATENT DOCUMENTS

| | | | | |
|---|---|---|---|---|
| 8,433,461 | B2 | 4/2013 | Daum et al. | |
| 8,589,057 | B2 | 11/2013 | Kickbusch et al. | |
| 8,626,193 | B1 | 1/2014 | Crossno et al. | |
| 8,702,043 | B2 | 4/2014 | Daum et al. | |
| 8,751,073 | B2 * | 6/2014 | Kumar | B61L 613/006 701/19 |
| 8,805,605 | B2 * | 8/2014 | Cooper | B61L 27/0027 104/76 |
| 8,820,685 | B2 * | 9/2014 | Michaut | B61L 11/08 246/131 |
| 9,037,388 | B2 * | 5/2015 | McCrary | B60C 7/00 701/117 |
| 2001/0044695 | A1 * | 11/2001 | Doner | B61L 15/0027 701/482 |
| 2006/0089787 | A1 | 4/2006 | Burr et al. | |
| 2010/0332058 | A1 * | 12/2010 | Kane | B61L 25/025 701/20 |
| 2011/0167128 | A1 | 7/2011 | Raghunathan et al. | |
| 2012/0136515 | A1 | 5/2012 | Noffsinger et al. | |

* cited by examiner

METHOD AND SYSTEM FOR COMMUNICATING DATA WITH VEHICLES

CROSS-REFERENCE TO RELATED APPLICATIONS

This application claims priority to U.S. Provisional Application No. 62/031,267, filed Jul. 31, 2014, which is incorporated by reference herein.

FIELD

Embodiments of the subject matter described herein relate to vehicles traveling on trips along routes and communication of data with the vehicles.

BACKGROUND

Some known vehicle systems include software applications that automatically control a throttle and brake of a vehicle in the vehicle system and/or suggest control settings for the throttle and brake of the vehicle as the vehicle system travels on a trip along a route. For example, a Trip Optimizer™ system of General Electric Company may automatically control the throttle and brakes of a vehicle, or may coach an operator how to control the throttle and brakes, based on a trip plan in order to increase efficiency, such as by reducing fuel use, while helping to keep the vehicle on schedule. The Trip Optimizer™ system creates the trip plan by collecting various input information related to the vehicle system and the trip, such as the length and weight of the vehicle system, the grade and conditions of the route that the vehicle will be traversing, weather conditions, performance of the rail vehicle, or the like. The system uses the input information to calculate an efficient way of running the vehicle system along the trip.

Some vehicle systems may travel long distances along a route from an origination location to a destination location. As the length of the trip increases, the amount of input information collected and considered in order to produce a trip plan for the trip also increases. Some of the information may be transmitted remotely from an off-board system, such as a dispatch facility. For example, the off-board system may transmit the input information to the vehicle to be used for generating a trip plan, or the off-board system may transmit a pre-constructed trip plan to the vehicle. Either way, as the amount of information transmitted increases, so too does the likelihood of an error in transmission that prevents the vehicle from receiving at least some of the information. Without receiving the information, the vehicle may not be able to construct a trip plan, travel along the trip according to a trip plan, or at least may not travel according to the most efficient trip plan available, which reduces the efficiency of the trip and represents an opportunity loss.

BRIEF DESCRIPTION

In an embodiment, a method (e.g., for communicating data) is provided that includes defining a pre-load zone along a route being traveled by a vehicle. The pre-load zone has reliable communication. The pre-load zone is associated with a trip of the vehicle along the route. A starting location of the trip is located outside of the pre-load zone. The vehicle is configured to cross a first boundary of the pre-load zone to enter the pre-load zone and cross a second boundary of the pre-load zone to exit the pre-load zone prior to reaching the starting location of the trip. The method includes receiving a trip request message from the vehicle after the vehicle has entered the pre-load zone and prior to the vehicle exiting the pre-load zone. The trip request message identifies the pre-load zone. The method also includes sending a trip response message to the vehicle such that the vehicle receives the trip response message prior to the vehicle exiting the pre-load zone. The trip response message includes trip data specific to the trip that starts at the starting location outside of the pre-load zone. The trip data is selected based on the association between the pre-load zone and the trip.

In an embodiment, a method is provided that includes identifying a vehicle traveling on a route entering a pre-load zone. The pre-load zone defines an area of the route between at least two boundaries that is associated with reliable communication. The pre-load zone lies outside a communication dead zone that is associated with unreliable communication. The communication dead zone encompasses a starting location for a trip of the vehicle along the route. The method includes sending a trip request message to an off-board system from the vehicle after the vehicle enters the pre-load zone and before the vehicle enters the communication dead zone. The method also includes receiving a trip response message at the vehicle from the off-board system before the vehicle enters the communication dead zone. The trip response message includes trip data specific to the trip that starts at the starting location in the communication dead zone. The method includes storing the trip data on a memory device disposed on the vehicle. Upon receiving a trip initialization request, the method further includes retrieving the trip data from the memory device and controlling movements of the vehicle beyond the starting location of the trip based on the trip data.

In an embodiment, a system is provided that includes a communication system, a memory device, and an energy management system. The communication system is configured to be disposed onboard a vehicle traveling on a route that has a defined pre-load zone associated with reliable communication. The pre-load zone lies outside of a communication dead zone associated with unreliable communication. The communication dead zone encompasses a starting location for a trip of the vehicle along the route. The communication system is configured to send a trip request message to an off-board system after the vehicle enters the pre-load zone and before the vehicle enters the communication dead zone. The trip request message identifies the pre-load zone. The communication system is further configured to receive a trip response message from the off-board system before the vehicle enters the communication dead zone. The trip response message is responsive to the trip request message and includes trip data specific to the trip that starts in the communication dead zone. The trip is identified based on the identification of the pre-load zone in the trip request message. The memory device is configured to be disposed onboard the vehicle. The memory device is configured to store the trip data received from the off-board system. The energy management system is configured to be disposed onboard the vehicle. The energy management system is configured to retrieve the trip data from the memory device and control movement of the vehicle, based on the trip data, after the vehicle reaches the starting location of the trip.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
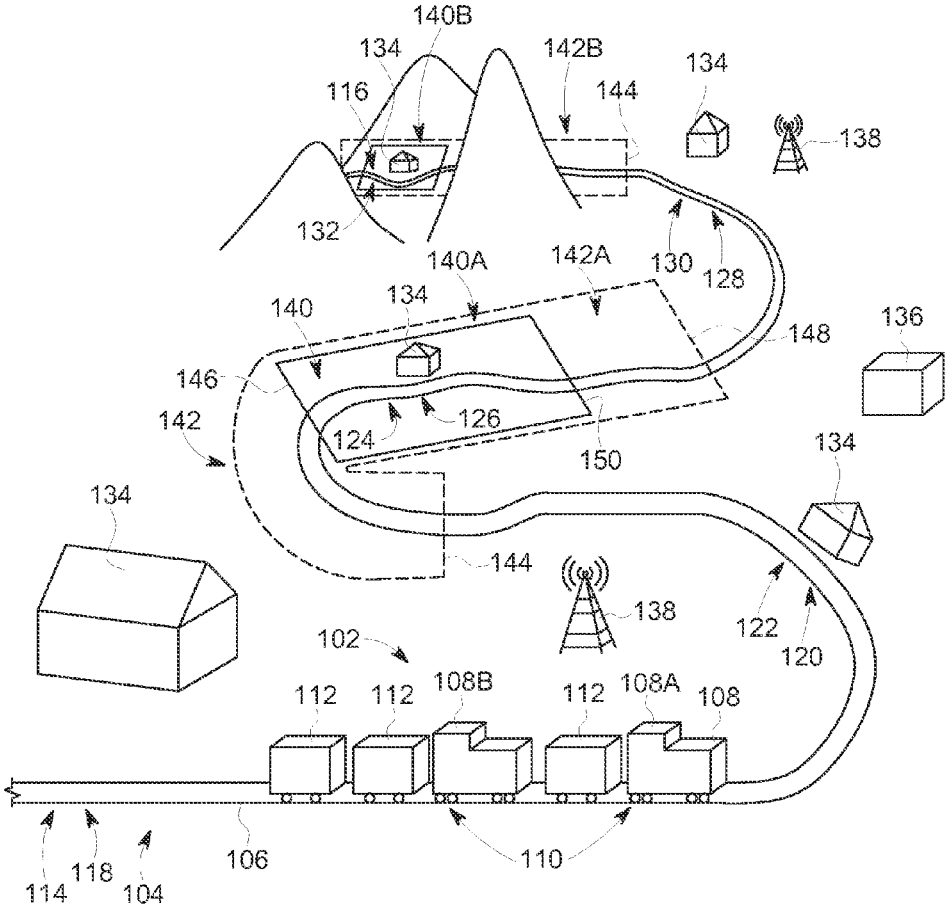
FIG. 1 is an illustration of a vehicle system traveling along a route in accordance with an embodiment.

The foregoing summary, as well as the following detailed description of certain embodiments of the inventive subject matter, will be better understood when read in conjunction with the appended drawings. To the extent that the figures illustrate diagrams of the functional blocks of various embodiments, the functional blocks are not necessarily indicative of the division between hardware and/or circuitry. Thus, for example, one or more of the functional blocks (for example, processors, controllers, or memories) may be implemented in a single piece of hardware (for example, a general purpose signal processor, microcontroller, random access memory, hard disk, or the like). Similarly, any programs and devices may be standalone programs and devices, may be incorporated as subroutines in an operating system, may be functions in an installed software package, or the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the inventive subject matter are not intended to be interpreted as excluding the existence of additional embodiments that also incorporate the recited features. Moreover, unless explicitly stated to the contrary, embodiments "including," "comprising," or "having" (and various forms thereof) an element or a plurality of elements having a particular property may include additional such elements not having that property.

As used herein, the terms "module", "system," "device," or "unit," may include a hardware and/or software system and circuitry that operates to perform one or more functions. For example, a module, unit, device, or system may include a computer processor, controller, or other logic-based device that performs operations based on instructions stored on a tangible and non-transitory computer readable storage medium, such as a computer memory. Alternatively, a module, unit, device, or system may include a hard-wired device that performs operations based on hard-wired logic and circuitry of the device. The modules, units, or systems shown in the attached figures may represent the hardware and circuitry that operates based on software or hardwired instructions, the software that directs hardware to perform the operations, or a combination thereof. The modules, systems, devices, or units can include or represent hardware circuits or circuitry that include and/or are connected with one or more processors, such as one or computer microprocessors.

One or more embodiments disclosed herein describe a method and system used in conjunction with a vehicle traveling along a route. The vehicle may be a part of a vehicle system that includes multiple vehicles. The movements of the vehicle traveling along the route during the trip may be controlled based on trip data communicated to the vehicle from an off-board system. The route may be segmented into multiple trips, and the trip data communicated to the vehicle may be specific to individual upcoming trips of the vehicle to limit the amount of information transmitted and the latency of the information (improving the accuracy of the information). In order to prohibit a situation in which the vehicle does not receive relevant trip data before an upcoming trip due to unreliable communication along an area of the route, in one or more embodiments described herein the route may be mapped to identify zones associated with unreliable communication. Additional areas on one or both sides of the zones may be determined that are associated with reliable communication. Thus, instead of attempting communications between the vehicle and the off-board system within the unreliable zones, the vehicle may be configured to track its movement relative to the areas associated with reliable communication and send a request for trip data to the off-board system upon entering one of the reliable communication areas. In this way, the vehicle may receive the relevant trip data for the upcoming trip prior to entering an unreliable communication zone. Once the vehicle reaches a starting location for the trip that is within the unreliable communication zone, the movement of the vehicle may be controlled based on the trip data that was communicated prior to entering the unreliable communication zone. The vehicle may travel more efficiently when controlled based on the trip data as opposed to traveling on the trip without using trip data communicated from the off-board system.

At least one technical effect of various examples of the inventive subject matter described herein may include increased availability of trip-specific data that is used for controlling a vehicle traveling on a trip along a route. Another technical effect may include increased number of opportunities to use energy management systems on a vehicle to control the movement of the vehicle efficiently using received trip-specific data. A technical effect of increased use of energy management systems to control movement of a vehicle is improved efficiency of the vehicle along the trip. Another technical effect may include accomplishing successful communication of trip data specific to an area of the route that has unreliable communication without requiring installation of additional communication infrastructure.

A more particular description of the inventive subject matter briefly described above will be rendered by reference to specific embodiments thereof that are illustrated in the appended drawings. The inventive subject matter will be described and explained with the understanding that these drawings depict only typical embodiments of the inventive subject matter and are not therefore to be considered to be limiting of its scope. Wherever possible, the same reference numerals used throughout the drawings refer to the same or like parts.

FIG. 1 is an illustration of a vehicle system 102 traveling along a route 104 in accordance with an embodiment. The vehicle system 102 includes one or more vehicles, including at least one propulsion-generating vehicle 108 that generates tractive effort to travel along the route 104. The vehicle system 102 shown in FIG. 1 includes two plural propulsion-generating vehicles 108 (e.g., vehicles 108A and 108B) that are mechanically and/or communicatively coupled with each other to travel together along the route 104. For example, the vehicles 108A, 108B may be logically linked with each other such that movements of the vehicle 108A along the route 104 are coordinated with movements of the vehicle 108B, even if the vehicles 108A, 108B are not mechanically interconnected. Two or more coupled propulsion-generating vehicles 108 may form a consist or group 110. The vehicle system 102 may include a single consist 110, as shown in FIG. 1, or multiple consists interspersed along the vehicle system 102. In a distributed power operation, the consist 110 may include a lead vehicle 108 mechanically linked to one or more remote vehicles 108, where tractive and braking efforts of the remote vehicles 108 are controlled by the lead vehicle 108. Although not shown in FIG. 1, instead of vehicle system 102, a single vehicle (for example, a single propulsion-generating vehicle 108) may travel along the route 104.

In addition to one or more propulsion-generating vehicles 108, the vehicle system 102 may include at least one non-propulsion-generating vehicle 112 coupled to, and propelled by, the one or more propulsion-generating vehicles 108. Optionally, the vehicle system 102 may not include any non-propulsion-generating vehicles 112. The non-propulsion-generating vehicles 112 may include braking systems to generate braking efforts, but not propulsion systems to generate tractive efforts. The non-propulsion-generating vehicles 112 may be configured to receive a load for transport including cargo and/or passengers. Cargo may include bulk material (e.g., coal, steel, wood, etc.), intermodal containers, general freight, and the like. The number and arrangement of the propulsion-generating vehicles 108 and non-propulsion vehicles 112 illustrated in FIG. 1 is merely an example, as other embodiments of the vehicle system 102 may use different vehicle arrangements and/or different numbers of vehicles. For example, the vehicle system 102 in an alternative embodiment may include a greater proportion of non-propulsion-generating vehicles 112 to propulsion-generating vehicles 108. Furthermore, one or more of the embodiments described herein may be performed on or by a single vehicle (for example, a single propulsion-generating vehicle 108) traveling on the route 104, where the vehicle is not part of a vehicle system.

The route 104 may be defined by a track 106 on which the vehicle system 102 travels. The route 104 extends from an origination location 114 to a destination location 116. The vehicle system 102 starts a journey along the route 104 at the origination location 114, and completes the journey at the destination location 116. For example, the origination location 114 may be at or near a port, and the destination location 116 may be at or near a mine, such as when the vehicle system 102 is set to travel from the port to the mine to receive a load of cargo at the mine to be transported back to the port. The journey between the origination location 114 and the destination location 116 may be divided into several segments, referred to herein as trips, along the length of the journey. Each trip extends between a starting location and an ending location. As shown in FIG. 1, the journey may be segmented into four trips, with a first trip defined between a first starting location 118 and a first ending location 120, a second trip defined between a second starting location 122 and a second ending location 124, a third trip defined between a third starting location 126 and a third ending location 128, and a fourth trip defined between a fourth starting location 130 and a fourth ending location 132. The first starting location 118 may be at the origination location 114 of the journey, and the fourth ending location 132 may be at the destination location 116. The trips may be arranged in consecutive order, such that the ending location of one trip is the starting location of the next trip. As such, the first ending location 120 may be at the second starting location 122, the second ending location 124 may be at the third starting location 126, and the third ending location 128 may be at the fourth starting location 130.

The journey may be divided into trips to provide time and places for crew changes, re-fueling, rest stops, maintenance, and the like. Optionally, the starting locations for at least some of the trips may be located at stations 134. The stations 134 may be crew change stations in which the existing crew on the vehicle system 102 may be substituted with a new crew that is waiting at the station 134. In other embodiments, the trips may start and/or end at locations other than stations 134. For example, one trip may end at a pull-off section of the track 106 instead of at a station 134.

In an embodiment, the vehicle system 102 may be a train configured to move on a track 106 composed of rails. The propulsion-generating vehicles 108 may be locomotives interspersed among a plurality of rail cars throughout the length of the train to supply motive power and braking action for the train. In another embodiment, the propulsion-generating vehicles 108 may be trucks and/or automobiles configured to drive on a track 106 composed of pavement (e.g., a highway). The vehicle system 102 may be a group or consist 110 of trucks and/or automobiles that are logically coupled so as to coordinate movement of the vehicles 108 along the pavement. In other embodiments, the vehicles 108 may be off-highway vehicles (e.g., mining vehicles and other vehicles that are not designed for or permitted to travel on public roadways) traveling on a track 106 of earth, marine vessels traveling on a track 106 of water, aerial vehicles traveling on a track 106 of air, and the like. Thus, although some embodiments of the inventive subject matter may be described herein with respect to trains, locomotives, and other rail vehicles, embodiments of the inventive subject matter also are applicable for use with vehicles generally.

As the vehicle system 102 travels along the route 104 on the journey, the vehicle system 102 may be configured to communicate with an off-board system 136. The off-board system 136 may be configured to receive a request for trip data from the vehicle system 102, interpret and process the request, and transmit trip data back to the vehicle system 102 in a response. In an exemplary embodiment, the trip data may correspond to specific trips along the route. For example, the vehicle system 102 may send a request message as the vehicle system 102 approaches the first ending location 120 at the end of the first trip. The off-board system 136 may respond to the request by sending trip data related to the second trip that starts at the starting location 122.

The trip data may include a trip plan that provides tractive and/or braking settings for the vehicle system 102 to implement as the vehicle system 102 travels on the second trip to the second ending location 124. Alternatively, the trip data may include trip information, vehicle information, track information and/or an update to trip information, vehicle information, or track information, and the trip data may be used by an energy management system 216 (shown in FIG. 2) on the vehicle system 102 to generate a trip plan for the second trip. Vehicle information includes vehicle makeup information of the vehicle system 102, such as model numbers, manufacturers, horsepower, number of vehicles, vehicle weight, and the like, and cargo being carried by the vehicle system 102, such as type and amount of cargo carried. Trip information includes information about the upcoming trip, such as starting and ending locations, station information, restriction information (such as identification of work zones along the trip and associated speed/throttle limitations), and/or operating mode information (such identification of speed limits and slow orders along the trip and associated speed/ throttle limitations). Track information includes information about the track 106 along the trip, such as locations of damaged sections, sections under repair or construction, the curvature and/or grade of the track 106, global positioning system (GPS) coordinates of the trip, weather reports of weather experienced or to be experienced along the trip, and the like. The term "trip data" may refer to trip information, vehicle information, and track information in combination, only one of trip information, vehicle information, or track information, or another type of information instead of or in addition to trip information, vehicle information, and/or track information.

The vehicle system 102 may travel along the second trip according to the received trip data. Once the vehicle system 102 reaches or approaches the second ending location 124 to end the second trip, the vehicle system 102 transmits another request for trip data to the off-board system 136, this time requesting trip data specific to the third trip that starts at the starting location 126.

In this way, the vehicle system 102 travels along the route 104 one trip at a time, and movement during each trip is controlled based on received trip data from the off-board system 136 specific to the upcoming trip. The movement of the vehicle system 102 may be more efficient when controlled according to the received trip data than when not controlled according to received trip data. In addition, the movement of the vehicle system 102 may be more efficient when the trip data is received in packets related to segments of the route 104 as the vehicle system 102 travels along the route 104 than if trip data for the entire journey between the origination location 114 and the destination location 116 is received at the start of the journey. For example, at least some of the input information that forms the trip data is temporal, with fleeting relevance and accuracy. Conditions of the track, weather, work zones, slow orders, and even vehicle conditions may change with time and may be hard to predict in advance. In some known communication systems, for a journey taking multiple days to complete, the vehicle system may travel according to a trip plan generated from trip data collected prior to the journey. The parameters and/or conditions of the vehicle, the route, and/or the journey may change as the vehicle travels, so the trip data used to generate the trip plan becomes stale and inaccurate. As a result, the movement of the vehicle is based on at least some inaccurate data, minimizing the achievable efficiency of the journey. Thus, reducing the latency of the trip data improves the accuracy of the trip plan and the efficiency of vehicle movement along the journey.

In order to reduce the latency of trip data, in some known communication systems, the vehicle system may wait until reaching or at least approaching an ending location of a first trip before requesting information related to a second trip that starts at the ending location of the first trip. For example, as shown in FIG. 1, the vehicle system 102 traveling according to a known communication system may wait until reaching the station 134 (or reaching a configurable proximity to the station 134) at the ending location 124 of the second trip before sending a request message to the off-board system 136 or other off-board location requesting trip data specific to the third trip that starts at the starting location 126. The off-board system 136, in response to the request, may collect the trip data relevant to the third trip and sends the trip data to the vehicle system 102 for the vehicle system 102 to use when traveling along the third trip. Since the trip data is collected closer in time to when the vehicle system 102 travels along the third trip than if trip data for the entire journey was collected and sent to the vehicle system 102 prior to starting the journey, the trip data is more accurate, so the movement of the vehicle system 102 along the third trip may be more efficient. In addition, by breaking up the journey into segments and communicating trip data related to each segment individually, the amount of information transmitted may be reduced, and therefore, more likely to be received by the vehicle system 102 without information (for example, data packets) being dropped in transit or other transmission errors.

The vehicle system 102 may communicate with the off-board system 136 wirelessly. Wireless base stations 138, such as cell towers, may provide wireless networks and boost signal strength and quality along the route, increasing the reliability of communication between the vehicle system 102 and the off-board system 136. Areas of the route 104 near base stations 138 may support reliable communications between the vehicle system 102 and the off-board system 136. However, some areas of the route 104 may be associated with poor or unreliable communication. For example, the journey may be relatively long and cover hundreds of miles, so some areas may have weak signal strength and/or quality due to being located a long distance from a base station 138, due to natural and/or artificial obstructions, or the like. An area along the route 104 associated with unreliable communication, due to weak signal strength and/or quality, is referred to herein as a communication dead zone 140. As shown in FIG. 1, the route 104 includes two communication dead zones 140 (e.g., a first communication dead zone 140A and a second communication dead zone 140B). The first communication dead zone 140A encompasses the starting location 126 of the third trip (and the ending location 124 of the second trip). The communication dead zone 140A may have weak signal strength and/or quality due to long distances from the base stations 138. The second communication dead zone 140B may have weak signal strength and/or quality due to natural obstructions caused by mountainous geography, as shown in FIG. 1. Within the communication dead zones 140, the vehicle system 102 is not able to reliably communicate with the off-board system 136, so the requested trip data for an upcoming trip may not be successfully received by the vehicle system 102. As used herein, communication "dead" zone does not necessarily mean that no communications are possible within the zone, although that is one possibility.

With continued reference to known communication systems in which a vehicle system requests trip information for one trip at a time along a longer route, such communication systems are vulnerable to communication dead zones. For example, as the vehicle system 102 reaches the station 134 at the ending location 124 of the second trip, the station 134 is within the communication dead zone 140A. According to one or more known communication systems, the vehicle system 102 may request trip information for the upcoming third trip of the journey once the vehicle system 102 reaches or at least approaches the station 134. But, since the station 134 is within the communication dead zone 140A, the request may not be successfully received by the off-board system 136 and/or the response from the off-board system 136 may not be successfully received by the vehicle system 102. The waiting time of the vehicle system 102 at the station 134 may increase as the vehicle system 102 delays the start of the third trip while attempting to establish successful communication with the off-board system 136, which may put the journey off schedule. Eventually, the vehicle system 102 may begin to travel along the third trip without following a trip plan at all or by implementing a past trip plan that is not accurate to current conditions. In either scenario, the vehicle system 102 would not be traveling efficiently along the third trip since the vehicle system 102 is not able to receive timely, accurate information related to the third trip. Thus, previous attempts to communicate data related to a journey to a vehicle system resulted in vulnerabilities to stale, inaccurate information and failed information transmission due to communication dead zones encountered along the route. The subject matter described herein provides novel and non-obvious solutions to the problem of communicating timely data to a vehicle system at various locations along a route during a journey.

In an embodiment, a pre-load zone 142 is defined around each communication dead zone 140. The pre-load zone 142 is a pre-defined area along the route 104 that lies outside of the communication dead zone 140. The pre-load zone 142 may or may not be contiguous with the respective communication dead zone 140. As shown in FIG. 1, the route 104 includes a first pre-load zone 142A that surrounds or borders the first communication dead zone 140A, and a second pre-load zone 142B surrounds or borders the second communication dead zone 140B. For example, each of the pre-load zones 142A, 142B extends further along the route 104 in both directions than the respective communication dead zones 140A, 140B. As the vehicle system 102 moves along the route 104, the vehicle system 102 enters a first portion of the pre-load zone 142 first, then enters the communication dead zone 140 surrounded by the pre-load zone 142, then finally enters a second portion of the pre-load zone 142, before exiting the pre-load zone 142. In an alternative embodiment, the first and second portions of each pre-load zone 142 may be characterized as two discrete and distinct pre-load zones 142. For example, as the vehicle system 102 moves along the route, the vehicle system 102 enters a first pre-load zone 142, then enters a communication dead zone 140, and then enters a second pre-load zone 142.

The pre-load zone 142 is associated with reliable communication. The pre-load zone 142 may have strong or at least adequate wireless signal strength and/or quality. The at least adequate signal strength and/or quality may be attributable to proximity to a base station 138 that boosts the signal, to a lack of natural and/or artificial obstructions, and/or the like. When the vehicle system 102 is within the pre-load zone 142, the vehicle system 102 is able to reliably communicate with the off-board system 136, such as to send trip requests and receive trip responses. The locations and boundaries of each pre-load zone 142 are known by the vehicle system 102, such as by storing the coordinates of the locations and boundaries in an on-board memory device.

In an embodiment, the vehicle system 102 tracks its movement as the vehicle system 102 travels on the second trip between the starting location 122 and the ending location 124. As soon as the vehicle system 102 recognizes that the vehicle system 102 has passed a first boundary 144 of the pre-load zone 142A and has entered the pre-load zone 142A, the vehicle system 102 may be configured to send a trip request message to the off-board system 136. The off-board system 136 receives the trip request message, processes the information in the request, formulates a trip response message, and transmits the trip response message back to the vehicle system 102 as the vehicle system 102 continues to travel towards the ending location 124 before the vehicle system 102 enters the communication dead zone 140A. Meanwhile, the vehicle system 102 may continue to send trip request messages to the off-board system 136 until the trip response is successfully received by the vehicle system 102 (or the vehicle system 102 exits the pre-load zone 142A). The trip response message includes trip data specific to the third trip that starts at the starting location 126 within the communication dead zone 140A. The vehicle system 102 is configured to store the trip data received in an on-board storage location, such as a memory device. Therefore, the trip data for the third trip is received by the vehicle system 102 prior to entering the communication dead zone 140A, so the vehicle system 102 need not attempt to communicate with the off-board system 136 while the vehicle system 102 travels through the communication dead zone 140A.

Upon the vehicle system 102 arriving at the ending location 124 of the second trip, which is the starting location 126 of the third trip, the trip data stored on the vehicle system 102 may be retrieved from storage and prepared for use in controlling the movement of the vehicle system 102 during the third trip. Therefore, as the vehicle system 102 embarks upon the third trip of the journey, starting within the communication dead zone 140A, trip data specific to the third trip is available for use by the vehicle system 102. In an embodiment, the crew may initialize the trip data such that the tractive and braking efforts of the vehicle system 102 along the trip to the third ending location 128 are controlled according to the trip data. If, for some reason, the crew does not initialize the trip data, in an embodiment the trip data is removed (for example, deleted) from the vehicle system 102 once the vehicle system 102 passes beyond a second boundary 148 of the pre-load zone 142A, exiting the pre-load zone 142A. Once the vehicle system 102 reaches the first boundary 144 of the second pre-load zone 142B, the vehicle system 102 sends another trip request message to the off-board system 136, and the process repeats.

As used herein, numerical terms such as "first" and "second" (for example, the first and second boundaries 144, 148 of the pre-load zones 142) are used merely for differentiation among the modified elements. For example, it is recognized that, depending on the direction of travel of the vehicle system 102, the first boundary 144 of the pre-load zone 142A shown in FIG. 1 may be the first or second boundary encountered by the vehicle system 102. The vehicle system 102 may be configured to undertake similar actions along the route 104 regardless of direction of travel.

Although the pre-load zone 142A shown in FIG. 1 has two identified boundaries 144, 148, the pre-load zone 142A may include additional boundaries, such as boundaries at or near the ends 146, 150 of the communication dead zone 140A. Thus, the identified boundary 148 may be a fourth boundary, for example, of the pre-load zone 142A (or a third boundary, a fifth boundary, or the like, depending on the number of identified boundaries). In other embodiments, the pre-load zones 142 may each be defined as two distinct pre-load zones or as having two distinct portions or areas lying outside of the corresponding communication dead zones 140. For example, the pre-load zone 142A may be divided into a first pre-load zone (or a first portion) that is defined between the first boundary 144 and a second boundary, which may be at or near the first end 146 of the communication dead zone 140A. Furthermore, upon or after exiting the communication dead zone 140A, the vehicle system 102 may cross a third boundary, which may be at or near the second end 150, to enter a second pre-load zone (or a second portion of the pre-load zone 142A). The vehicle system 102 exits the second pre-load zone (or second portion) upon crossing a fourth boundary 148.

Figure 2:
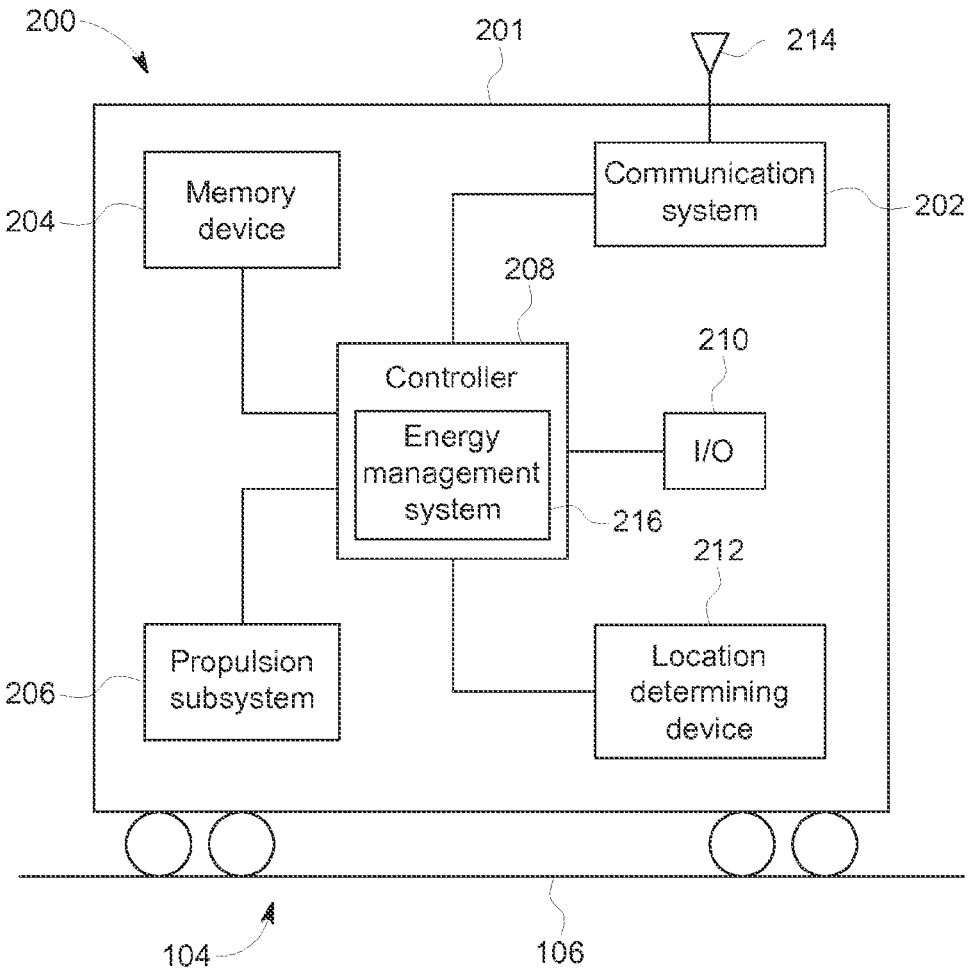
FIG. 2 illustrates a schematic diagram of a trip data communication system on a vehicle in accordance with an embodiment.

FIG. 2 illustrates a schematic diagram of a trip data communication system 200 on a vehicle 201 in accordance with an embodiment. The vehicle 201 may be a propulsion-generating vehicle 108 or a non-propulsion-generating vehicle 112 of the vehicle system 102 shown in FIG. 1. Alternatively, the vehicle 201 may be a single propulsion-generating vehicle 108 that is not part of a vehicle system. The vehicle 201 is configured to travel along the route 104 along the track 106. The trip data communication system 200 includes a communication system 202, a memory device 204, a propulsion subsystem 206, a controller 208, an input/output (I/O) device 210, and a location determining device 212. In other embodiments, the trip data communication system 200 may include one or more components in addition to the listed components and/or one or more of the listed components may be included on a different vehicle that is communicatively coupled to the vehicle 201 instead of being disposed on the vehicle 201.

The communication system 202 includes an antenna 214 that is electrically coupled to a transceiver or a separate transmitter and receiver. The communication system 202 is configured to wirelessly communicate with off-board locations, such as the off-board system 136 (shown in FIG. 1). For example, the communication system 202 is used to send trip request messages and to receive trip response messages.

The memory device 204 is an electronic storage device configured to store trip data received from the off-board system 136 (shown in FIG. 1). The memory device 204 may be configured to store additional information, such as coordinates of boundaries of pre-load zones 142 (shown in FIG. 1), current tracking information (such as speed and location) of the vehicle 201 as the vehicle travels along the route 104, vehicle makeup information, stored default trip plans, trip progress information, and the like. The contents of the memory device 204 are accessed by the controller 208 and/or an operator of the crew using the I/O device 210.

The propulsion subsystem 206 is configured to provide tractive efforts to propel the vehicle 201 along the route 104. The propulsion subsystem 206 may include one or more engines and/or motors, wheels, fins, or treads that engage the track material, and also a fuel or power source that energizes the engines and/or motors. The propulsion subsystem 206 may be associated with a braking subsystem (not shown) that is configured to slow movement of the vehicle 201 and/or prohibit movement of the vehicle 201 completely when actuated.

The I/O device 210 is configured to receive input information from one or more user devices, such as a keyboard, a mouse, a hand-held device (e.g., cell phone, tablet, PDA, etc.), and/or a graphical user interface of a display device. The I/O device 210 may transmit the input information to the controller 208 for processing. For example, an operator of the crew on the vehicle 201 may initialize a trip using the I/O device 210. Initializing a trip notifies the controller 208 that the crew desires controlling the movement of the vehicle 201 based on trip data, such as a trip plan. The I/O device 210 may also include an output component, such as a display device, used to display charts, graphs, and/or other indicia for the crew of the vehicle 201. For example, the I/O device 210 may display trip data for an upcoming trip so the crew may confirm whether the trip data is at least seemingly accurate and associated with the correct segment of the journey.

The location determining device 212 is configured to track the movement of the vehicle 201 along the route 104. For example, the location determining device 212 may use GPS to communicate with orbiting GPS satellites. The location determining device 212 may compare received communications from multiple satellites to determine the location of the device 212. The location of the vehicle 201 may be determined in coordinates. Alternatively, the location determining device 212 may communicate with sensors or markers along the route 104 to determine the location of the vehicle 201 along the route 104. The location determining device 212 may include wireless transceiving hardware and circuitry to triangulate the location of the vehicle system along the route using wireless signals. Furthermore, the data from multiple sensors may be used by the location determining device 212 to provide a more accurate location. The location determining device 212 may be used by the controller 208 to determine the location of the vehicle 201 continuously, or at various times along a trip, in order to determine the position of the vehicle 201 relative to the pre-load zones 142 (shown in FIG. 1).

The controller 208 of the trip data communication system 200 controls the transmission and receipt of trip messages via the communication system 202, the storage of the trip data on the memory device 204, and the use of the trip data to control movement of the vehicle 201 along the route 104. The controller 208 includes a logic subsystem, which may be provided as a processor that is configured to execute one or more instructions (for example, software instructions) that are part of one or more programs, routines, objects, components, data structures, or other logical constructs. Such instructions may be implemented to perform a task, implement a data type, transform the state of one or more devices, or otherwise arrive at a desired result. Additionally or alternatively, the controller 208 may include one or more hardware or firmware logic machines configured to execute hardware or firmware instructions. The controller 208 includes an energy management system 216. The energy management system 216 is configured to process the trip data received from the off-board system 136 (shown in FIG. 1), and use the trip data to control the movement of the vehicle 201 via the propulsion subsystem 206 and the braking subsystem. For example, if the trip data is not pre-processed into a trip plan upon receipt at the vehicle 201, the energy management system 216 may be configured to generate a trip plan for the vehicle 201 based on the trip data.

The trip plan, whether received intact within the trip data from the off-board system 136 (FIG. 1) or generated locally by the energy management system 216 based on the received trip data, includes operating parameters or orders for the vehicle 201 to follow during the trip. The parameters include tractive and braking efforts expressed as a function of location of the vehicle 201 along the trip, distance along the route, and/or time, as defined by the upcoming segment of the route 104. The trip plan optionally may also include additional information, such as suggested route taken, time schedule, energy usage, and the like. For example, at one location during the trip, the trip plan may instruct the vehicle 201 to increase tractive efforts to increase speed, while the trip plan may instruct the vehicle 201 to apply brakes to decrease speed at another location during the trip. The instructions presented by the trip plan may be implemented by the energy management system 216 by controlling the propulsion subsystem 206 and brakes automatically, or by notifying an operator of the crew of a suggested operating action. The energy management system 216 may notify the operator of the suggested operating action, such as to increase tractive effort, by displaying a message on the display of the I/O device 210 or a different display device.

The trip plan is configured to realistically maximize desired parameters, such as energy efficiency and speed, while meeting all constraints, such as speed limits, schedules, and the like. For example, the trip plan may minimize energy consumption during the trip while abiding by safety and regulatory restrictions. The trip plan may be established using an algorithm based on models for vehicle behavior for the vehicle system along the route. In an embodiment, the trip planner device 201 includes a software application such as the Trip Optimizer™ system provided by General Electric Company, or another energy management system. For additional discussion regarding a trip profile, see U.S. patent application Ser. No. 12/955,710, Publication No. 2012/0136515, "Communication System for a Rail Vehicle Consist and Method for Communicating with a Rail Vehicle Consist," filed 29 Nov. 2010, the entire contents of which are incorporated herein by reference.

Figure 3:
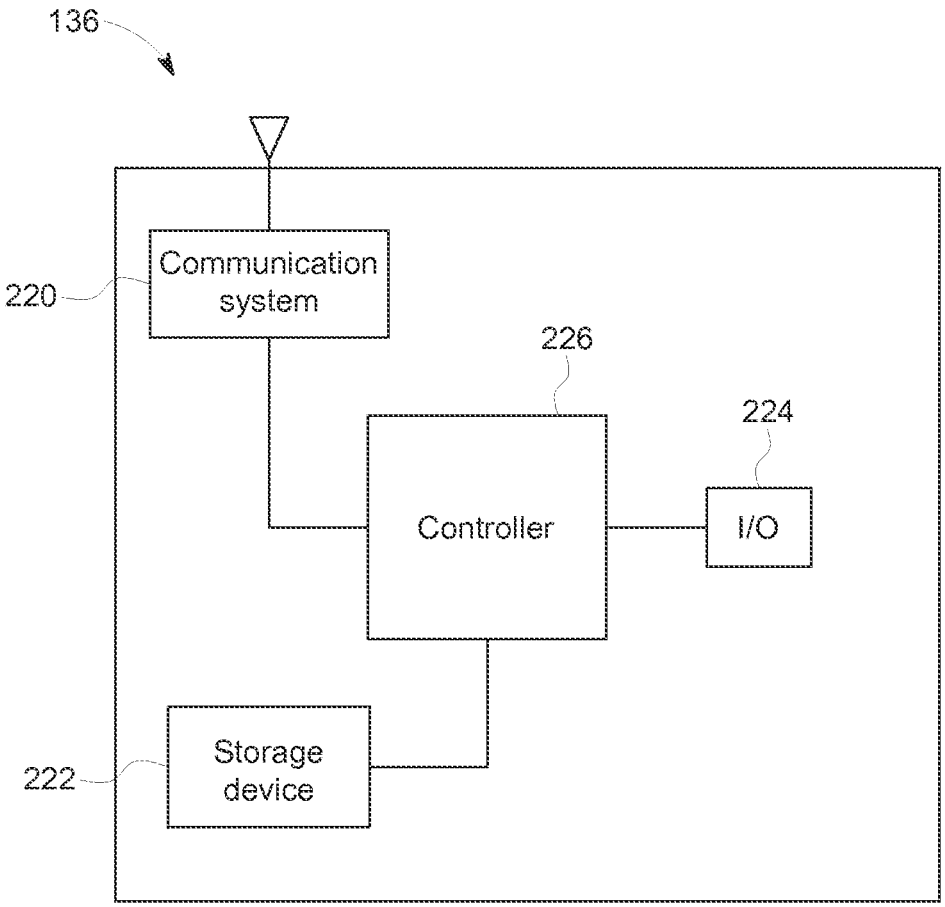
FIG. 3 illustrates a schematic diagram of an off-board system according to an embodiment.

FIG. 3 illustrates a schematic diagram of the off-board system 136 according to an embodiment. The off-board system 136 includes a communication system 220, a storage device 222, an I/O device 224, and a controller 226. Optionally, the off-board system 136 may include additional or fewer components than the components shown in FIG. 3.

The communication system 220 may be similar in structure to the communication system 202 shown and described in FIG. 2. For example, the communication system 220 is configured to communicate wirelessly with the communication system 202 on the vehicle 201 (shown in FIG. 2). The storage device 222 may be similar in structure to the memory device 204 shown in FIG. 2. The storage device 222 may be configured to store trip data relevant to the plural trips along the route 104 (shown in FIG. 1). Since the trip data may change over time, the storage device 222 may overwrite the stored trip data as updated information is received. Optionally, as described further below, the storage device 222 may also store reference tables that associate the trip data and the trips along the route 104 with corresponding pre-load zones 142, such that the correct trip data is sent to the requesting vehicle 201. The I/O device 224 may be similar in structure to the I/O device 210 shown in FIG. 2. For example, the I/O device 224 is configured to allow an operator at the off-board location of the off-board system 136 to control or at least verify the trip data that is sent to the vehicle 201 in the trip response message. The controller 226 may include a logic subsystem, such as a processor, like the controller 208 shown in FIG. 2. The controller 226 controls operation of the off-board system 136.

In an embodiment, the communication system 220 receives a trip request message from the vehicle 201 after the vehicle 201 enters a pre-load zone 142 (shown in FIG. 1). The communication system 220 transmits the trip request message to the controller 226. The controller 226 processes the trip request message to determine which vehicle sent the request message, the location of the vehicle that sent the request message, and whether the request message is requesting any information in addition to trip data for a next or at least upcoming trip. Optionally, the controller 226 may display at least a portion of the trip request message to an operator using a display of the I/O device 224. After determining the identity and location of the vehicle 201, the controller 226 may consult a reference table stored within the controller 226 or within the storage device 222 to determine the appropriate trip data to send to the vehicle 201. The controller 226 may then retrieve the trip data from the storage device 222, and control the communication system 220 to transmit a trip response message back to the vehicle 201 that includes the trip data.

Figure 4:
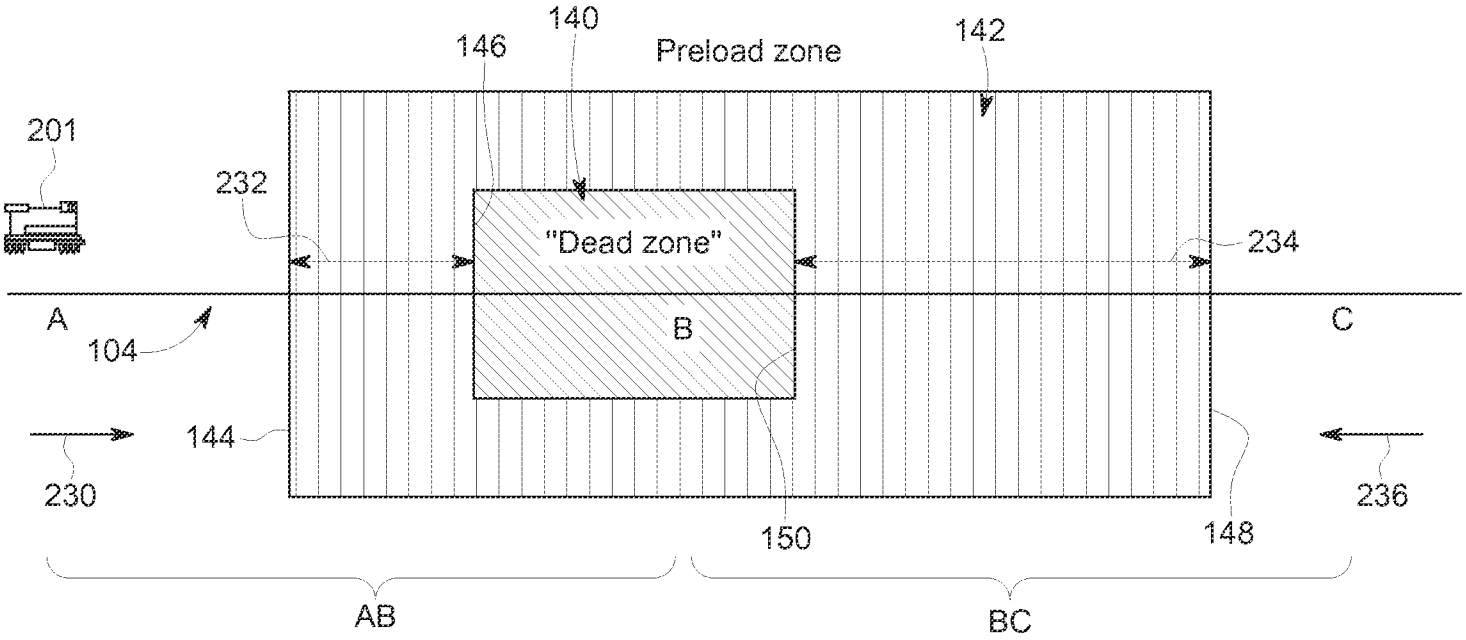
FIG. 4 is a schematic representation of a vehicle traveling on a route towards a communication dead zone and a pre-load zone according to an embodiment.

FIG. 4 is a schematic representation of a vehicle 201 traveling on a route 104 towards a communication dead zone 140 and a pre-load zone 142 according to an embodiment. The route 104 includes trip markers A, B, and C. The route 104 is segmented into trip AB, defined between markers A and B, and trip BC, defined between markers B and C. The vehicle 201 is located at marker A, which is the starting location of trip AB, and the vehicle 201 is traveling in direction 230 towards markers B and C. The communication dead zone 140 encompasses marker B, which is the starting location of trip BC. In known communication systems, the vehicle 201 may request trip data relevant to trip BC from the off-board system 136 (shown in FIG. 1) as the vehicle 201 approaches or reaches marker B. However, the marker B is within the communication dead zone 140, so communications to and from the off-board system 136 within the communication dead zone 140 are unreliable.

The communication dead zone 140 extends along the route 104 between the first end 146 and the second end 150. The location of the communication dead zone 140 and the length of the communication dead zone 140 between the ends 146, 150 may be determined or identified by monitoring wireless signal strength and/or quality while moving along the route 104. For example, a vehicle system may travel along the route 104 using a sensor that detects the strength and/or quality of wireless signal at numerous locations along the route 104 in order to map the route 104. Optionally, a detection location may be marked as within a dead zone if the signal strength and/or quality detected at the location are below a designated threshold value. The designated threshold may be a percentage of received signals or data packets detected by a sensor as compared to a total number of sent signals or data packets. The threshold value may be selected based on the knowledge that signal measurements at or above the threshold are adequate for reliable wireless communication. For example, the threshold may be designated as 80%, 90%, 95%, or the like. The communication dead zone 140, therefore, may be identified as a series of detection locations where the signal measurements consistently are lower than the designated threshold value. The ends 146, 150 of the dead zone 140 may be determined based on the signal measurements at detection locations outside of the ends 146, 150 consistently being at or higher than the designated threshold.

After the communication dead zone 140 is identified and the size of the dead zone 140 determined, the boundaries 144, 148 of the pre-load zone 142 that lies outside of the dead zone 140 may be defined. For example, the pre-load zone 142 may surround the dead zone 140 such that a first length 232 of the pre-load zone 142 extends between the first boundary 144 of the pre-load zone 142 and the first end 146 of the communication dead zone 140, and a second length 234 of the pre-load zone 142 extends between the second end 150 and the second boundary 148. In an embodiment, the first and second boundaries 144, 148 of the pre-load zone 142 are selected such that the corresponding first and second lengths 232, 234 of the pre-load zone 142 are each longer than a specified minimum distance. The specified minimum distance is the distance traversed by the vehicle 201 in the time required for both (i) successful transmission of the trip request message from the vehicle 201 and (ii) successful transmission of the trip response message to the vehicle 201. The specified minimum distance may be calculated assuming the vehicle 201 is traveling at designated speed limits of the section of the route 104 or a certain percentage over the designated speed limits. For example, assuming a traveling speed of the vehicle 201 at 50 miles per hour and 5 minutes required for successful transmission and receipt of communications, the corresponding length 232 or 234 should be about 4 miles long. The first and second lengths 232, 234 may, but need not, have equal distances. For example, the second length 234 shown in FIG. 4 is longer than the first length 232. The second length 234 may be longer than the first length 232 because vehicles travel faster in the direction 236 (opposite the direction 230) along trip CB than the vehicles are allowed to travel in the direction 230 along trip AB. Other reasons may be that more information is communicated along the second length 234 than the first length 232 or the signal quality along the second length 234 is inferior to the signal quality along the first length 232, so more time is necessary to ensure successful transmissions.

Each pre-load zone 142 may be associated with the trips that start within the communication dead zone 140 surrounded by the pre-load zone 142. For example, for a vehicle 201 traveling in direction 230 towards marker B, the pre-load zone 142 shown in FIG. 4 is associated with the trip BC. Conversely, for a vehicle 201 traveling in direction 236 towards marker B from marker C, the pre-load zone is associated with trip BA. In an embodiment, the pre-load zone 142 is assigned a pre-load zone identifier. The identifier is unique to each pre-load zone 142 along the route 104.

FIGS. 5A-D are schematic representations of the vehicle 201 at various locations while traveling on the route 104 shown in FIG. 4 according to an embodiment. The vehicle 201 is traveling the direction 230 on a journey that includes traveling over trip AB and then trip BC.

Figure 5A:
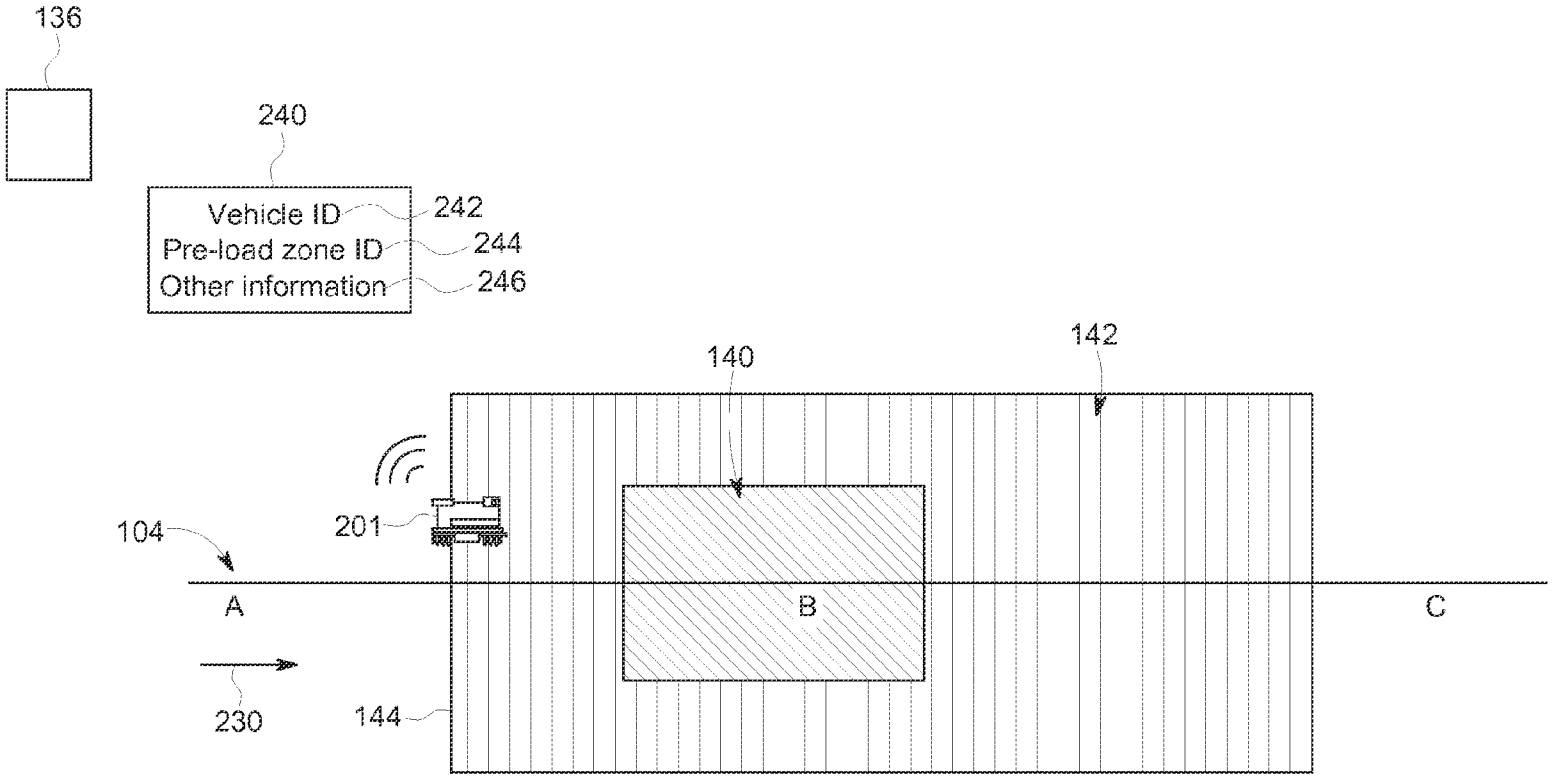
FIGS. 5A-5D are schematic representations of the vehicle shown in FIG. 4 at various locations while traveling on the route according to an embodiment.

At FIG. 5A, the vehicle 201 is at the first boundary 144 of the pre-load zone 142. The vehicle 201 may be tracking its location along the route 104 using the location determining device 212 (shown in FIG. 2). The coordinates of the first boundary 144 may be stored on the memory device 204 (FIG. 2) or another storage device on the vehicle 201 such that the vehicle 201 is able to identify when the vehicle 201 crosses the first boundary 144 and enters the pre-load zone 142. The identity and unique identifier of the pre-load zone 142 are also stored onboard the vehicle 201.

In an embodiment, the vehicle 201 is configured to transmit a trip request message 240 to the off-board system 136 as the vehicle 201 crosses the boundary 144. The trip request message 240 may include a vehicle identifier 242 that identifies the vehicle 201 sending the request message 240, a pre-load zone identifier 244 of the pre-load zone 142 that the vehicle 201 is entering, and any other information that is requested or provided by the vehicle 201 to the off-board system 136. Optionally, the trip request message 240 also identifies the direction of travel of the vehicle 201. The vehicle 201 may retransmit the trip request message 240 if a trip response message is not received within a pre-determined amount of time after transmitting the trip request message 240.

Upon receiving the trip request message 240, the off-board system 136 matches the pre-load zone identifier 244 to the pre-load zone 142 identified by the identifier 244 and also to the corresponding trip relevant to the vehicle 201 using one or more trip reference tables. For example, the trip reference table lists multiple trips along the route 104 and identifies corresponding pre-load zones 142 associated with the trips. The pre-load zones 142 are associated with the trips because the starting locations of the trips are within communication dead zones 140 surrounded by the pre-load zones 142. If a trip is identified, the off-board system 136 retrieves trip data specific to the trip. If a trip is not identified based on a received pre-load zone identifier 244, then the off-board system 136 may attempt to identify a trip using location processing and/or may send a response to the vehicle 201 notifying the vehicle 201 of the error. As described above, the off-board system 136 may determine the location of the vehicle 201 based on the pre-load zone identifier 244, without requiring the transmission of coordinates, which may reduce the size of the trip request message 240 and reduce the likelihood of errors in transmission. In other embodiments, the trip request message 240 may include coordinates of the vehicle 201 instead of, or in addition to, the pre-load zone identifier 244.

Figure 5B:
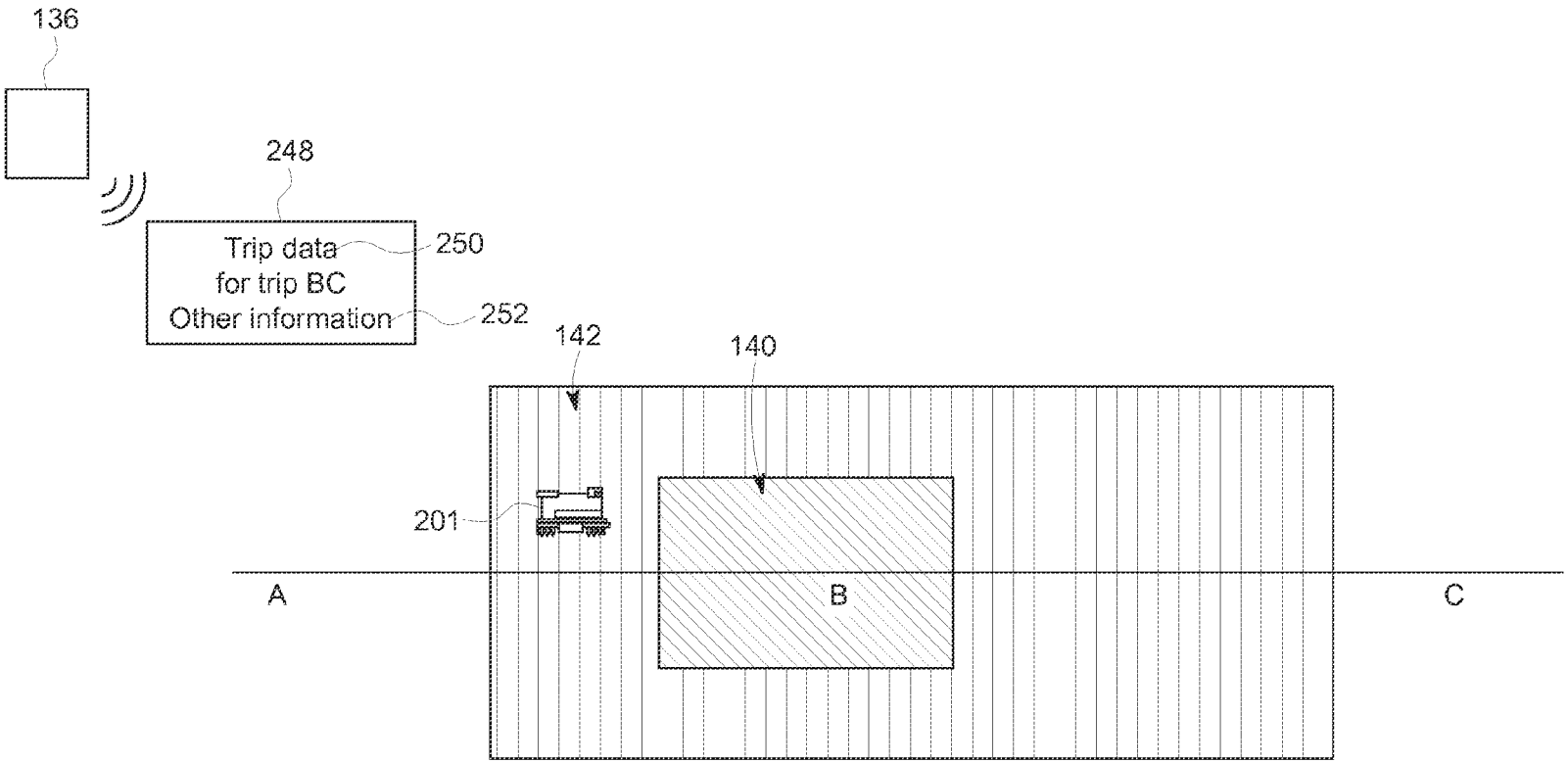

At FIG. 5B, the off-board device 136 forms a trip response message 248, and transmits the trip response message 248 to the vehicle 201 before the vehicle 201 enters the communication dead zone 140. The trip response message 248 includes trip data 250 for the trip BC that the vehicle 201 is approaching. The trip data 250 may be pre-formatted into a trip plan or may include various trip information, track information, and vehicle information that the energy management system 216 (shown in FIG. 2) may use to generate a trip plan for the trip BC. The trip response message 248 may also include other information 252. The other information 252 may be in response to a request in the trip request message 240, or may be information unrelated to the trip data 250 and unilaterally provided by the off-board system 136 for the vehicle 201.

Once the vehicle 201 receives the trip response message 248, the trip data 250 is stored in the memory device 204 (shown in FIG. 2). Any updates to the trip data 250 received from the off-board system 136 or another off-board device may also be stored in the memory device 204.

Figure 5C:
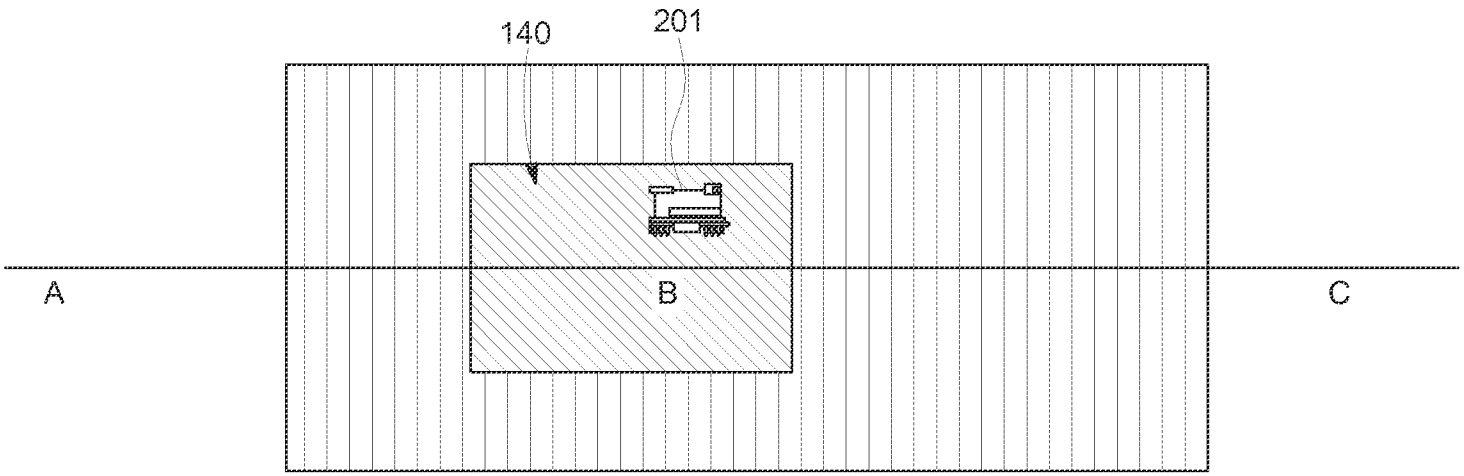

At FIG. 5C, the vehicle 201 is within the communication dead zone 140 and is at or near the marker B, which is the starting location for the trip BC. In an embodiment, the vehicle 201 does not take any action to use the stored trip data 250 until receiving a start trip initialization message provided by the crew or from an off-board controller. For example, the vehicle 201 may start to move along the trip BC without receiving the start trip initialization message, such that the vehicle 201 is not controlled based on the trip data 250. Once the start trip initialization message is received, the energy management system 216 (shown in FIG. 2) retrieves the trip data 250 from the memory device 204 (FIG. 2) and processes the trip data 250 for trip initialization. In an alternative embodiment, the trip initialization may begin automatically as soon as the vehicle 201 reaches the starting location of the trip (for example, marker B). During trip initialization, a trip plan may be displayed to an operator of the crew using a display of the I/O device 210 (FIG. 2). The operator may verify the information displayed using an input of the I/O device 210. Once confirmation is received, the energy management system 216 may begin to control movement of the vehicle 201 along the trip BC according to the trip plan. The trip data 250 may be removed from the memory device 204 since the trip data 250 is being used and will be too stale and inaccurate for future uses of the trip data 250. Removing the trip data 250 also clears up space in the memory device 204 and prohibits errors caused by accessing the wrong trip data in the future.

Figure 5D:
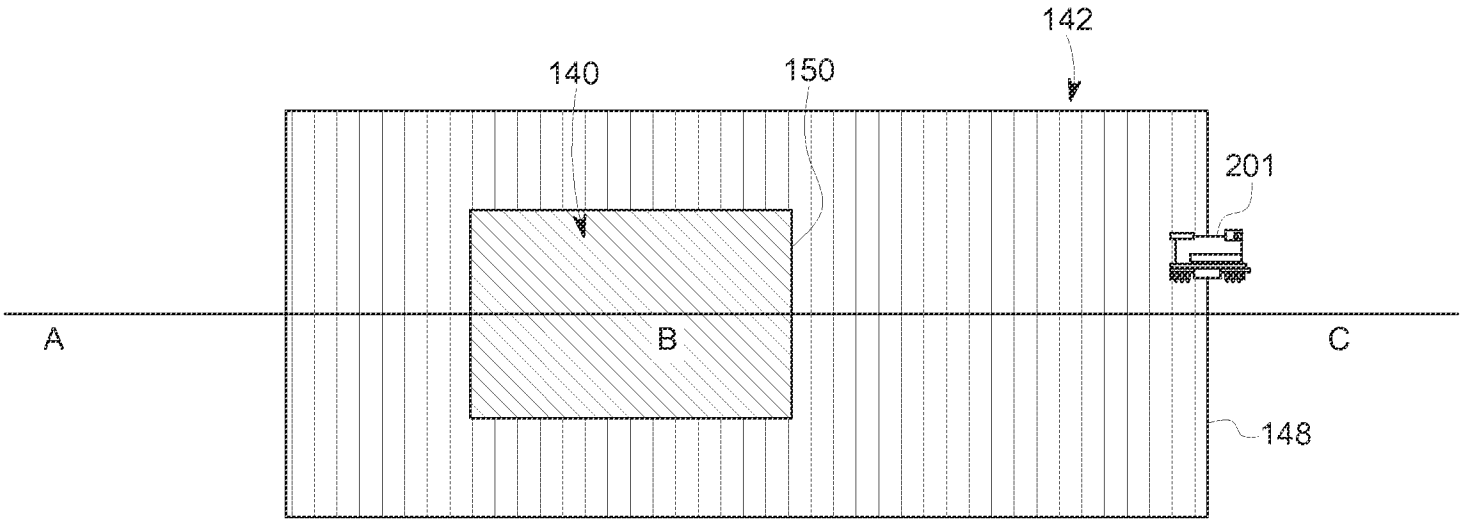

At FIG. 5D, the vehicle 201 is crossing the second boundary 148 of the pre-load zone 142. If no start trip initialization request has been received by the time the vehicle 201 reaches the boundary 148, the trip data 250 may be removed from the memory device 204. At this point, the trip data 250 might be stale and inaccurate. If a new trip initialization request is received, the vehicle 201 may request new trip data from the off-board system 136. In other embodiments, the trip data 250 may be deleted from the memory device 204 at a different set location if no trip initialization request has been received, such as at the second end of the communication dead zone 140 or once the vehicle 201 arrives at the ending location of the relevant trip (for example, marker C of trip BC). If the vehicle 201 is currently moving along the route 104 based on the trip data 250 at the location shown in FIG. 5D, then crossing the second boundary 148 may have no effect on the vehicle 201.

Figure 6:
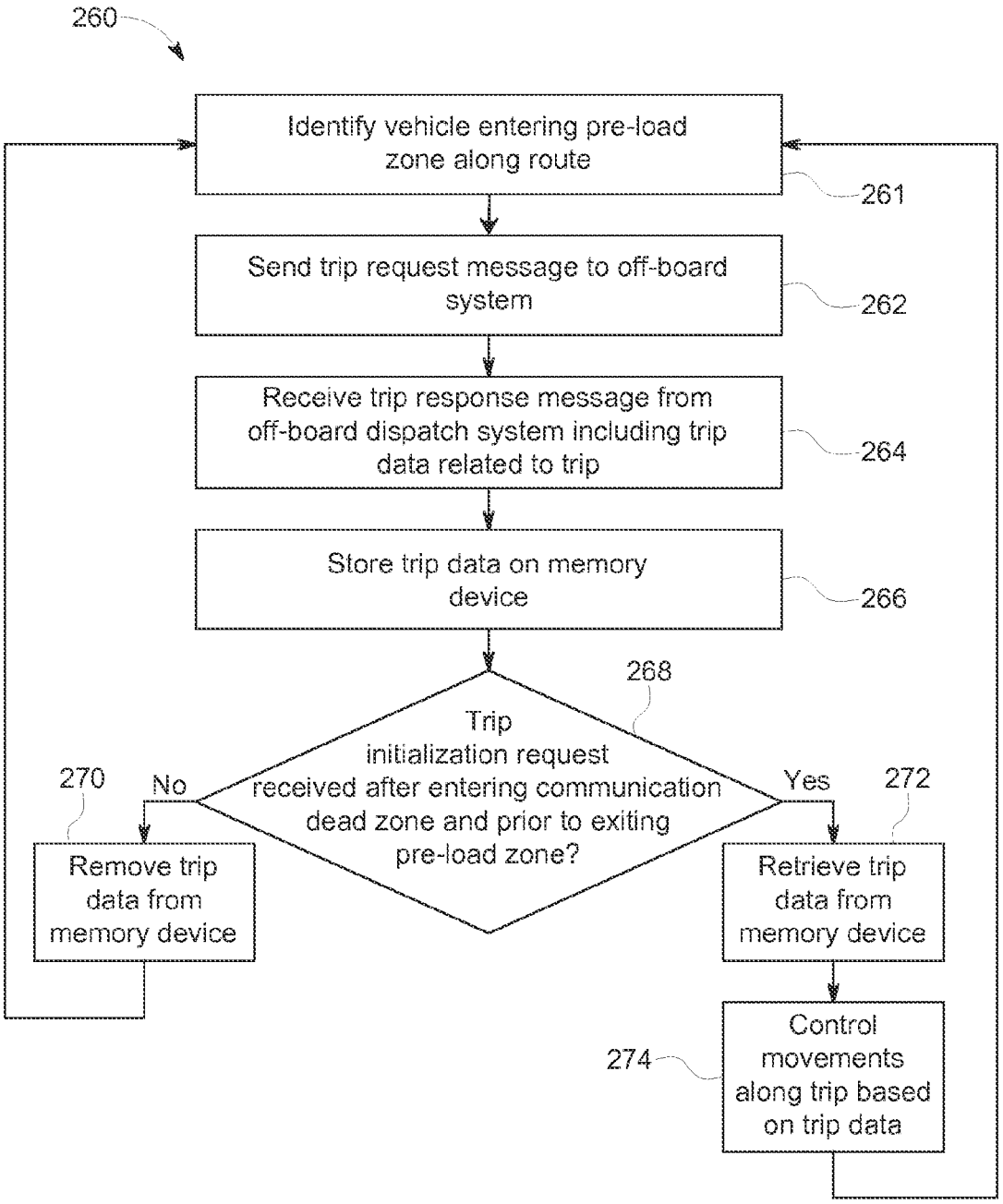
FIG. 6 is a flow diagram of a method for communicating trip data according to an embodiment.

FIG. 6 is a flow diagram of a method 260 for communicating trip data according to an embodiment. The method 260 may be performed by the trip data communication system 200 (shown in FIG. 2) that is disposed on the vehicle 201 (FIG. 2). At 261, the vehicle 201 entering a pre-defined pre-load zone along a route is identified. At 262, a trip request message is sent to an off-board system. At 264, a trip response message is received from the off-board system. The trip response message includes trip data related to a trip. The trip response message is responsive to the trip request message. At 266, the received trip data is stored on a memory device. The memory device may be onboard the vehicle 201. At 268, a determination is made whether a trip initialization request is received prior to exiting the pre-load zone. If no trip initialization request is received before exiting the pre-load zone and/or a pre-defined communication dead zone, then flow of the method 260 continues to step or operation 270. At 270, the trip data is removed from the memory device, and, after which, the flow of the method 260 returns to step or operation 261. If, however, a trip initialization request is indeed received prior to exiting the pre-load zone, then flow of the method 260 continues to step or operation 272. At 272, the trip data is retrieved from the memory device. At 274, one or more movements along the trip are controlled based on the trip data. Flow of the method 260 returns to step or operation 261 after step or operation 274.

Figure 7:
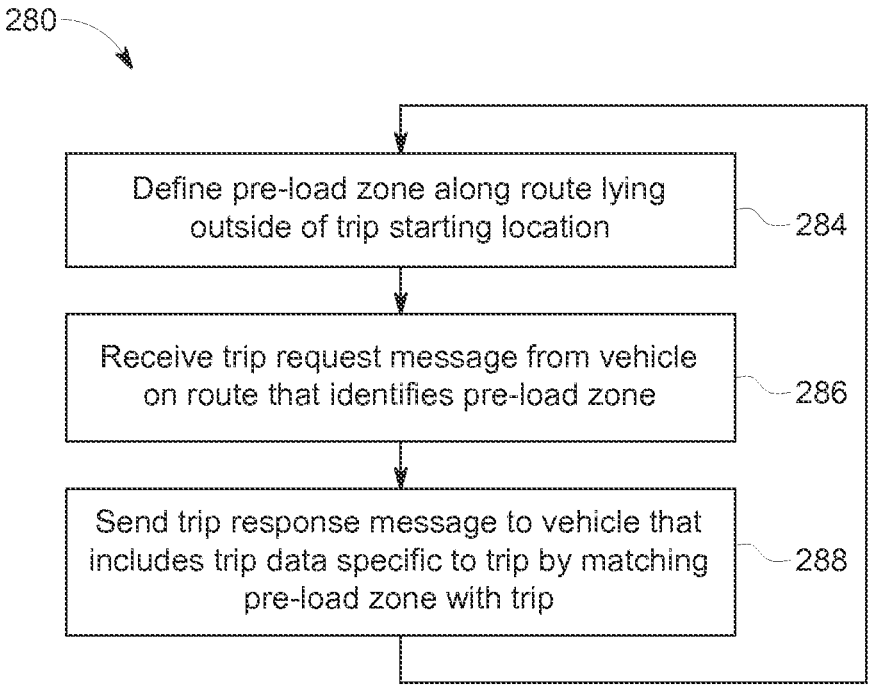
FIG. 7 is a flow diagram of another method for communicating trip data according to an embodiment.

FIG. 7 is a flow diagram of another method 280 for communicating trip data according to an embodiment. The method 280 may be performed by the off-board system 136 (shown in FIG. 3). At 284, a pre-load zone along a route is defined. The pre-load zone is an area that has reliable communication. Optionally, more than one pre-load zone is defined along the route. The pre-load zone is associated with a trip of a vehicle along the route that starts at a starting location lying outside of the pre-load zone. For example, the vehicle may cross a first boundary of the pre-load zone to enter the pre-load zone and then cross a second boundary of the pre-load zone to exit the pre-load zone (or a defined portion of the pre-load zone) prior to the vehicle reaching the starting location of the trip.

At 286, a trip request message from the vehicle on the route is received. The trip request message identifies the pre-load zone that the vehicle is traveling within. For example, the vehicle may be entering the pre-load zone. The identification of the pre-load zone may be in the form of a pre-load zone identifier that is included in the trip request message. The pre-load zone identifier may be a unique identifier specific to the pre-load zone, such as a unique binary code, frequency, or the like.

At 288, a trip response message is sent to the vehicle. The trip response message includes trip data specific to the trip that starts outside of the pre-load zone. The trip data is selected by matching the pre-load zone identified in the trip request message to the trip that starts at the starting location outside of the pre-load zone. Flow of the method 280 then returns to step or operation 284. Optionally, the vehicle may use the trip data to control movement of the vehicle along the trip. For example, the starting location of the trip may be within a communication dead zone, which is an area having or associated with unreliable communication. The pre-load zone is defined in an area of the route outside of the communication dead zone. In an embodiment, the trip request message may be received from the vehicle at 286 and the trip response message may be sent to the vehicle at 288 before the vehicle exits the pre-load zone and prior to the vehicle entering the communication dead zone. As a result, the vehicle receives trip data specific to the trip prior to entering a zone that has unreliable communication.

In an embodiment, a method (e.g., for communicating data) includes defining a pre-load zone along a route being traveled by a vehicle. The pre-load zone has reliable communication. The pre-load zone is associated with a trip of the vehicle along the route. A starting location of the trip is located outside of the pre-load zone. The vehicle is configured to cross a first boundary of the pre-load zone to enter the pre-load zone and cross a second boundary of the pre-load zone to exit the pre-load zone prior to reaching the starting location of the trip. The method includes receiving a trip request message from the vehicle after the vehicle has entered the pre-load zone and prior to the vehicle exiting the pre-load zone. The trip request message identifies the pre-load zone. The method also includes sending a trip response message to the vehicle such that the vehicle receives the trip response message prior to the vehicle exiting the pre-load zone. The trip response message includes trip data specific to the trip that starts at the starting location outside of the pre-load zone. The trip data is selected based on the association between the pre-load zone and the trip.

In an aspect, the pre-load zone extends a length along the route between the first and second boundaries. The first and second boundaries are selected such that the length of the pre-load zone is longer than a distance traversed by the vehicle in the time required for successful transmission of both the trip request message from the vehicle and the trip response message to the vehicle.

In an aspect, the association between the pre-load zone and the trip is contained in a trip reference table. The trip reference table lists multiple trips along the route and identifies corresponding pre-load zones associated with the trips.

In an aspect, the trip data is a trip plan that specifies tractive and braking settings to be provided by the vehicle during the trip as a function of location of the vehicle along an upcoming segment of the route.

In an aspect, the trip data includes at least one of vehicle makeup information, trip starting and ending locations, speed restrictions, work zone information, curvature and grade of the route information, or weather information that is specific to the trip.

In an aspect, the starting location for the trip is a crew change station.

In an aspect, the pre-load zone lies outside of a communication dead zone along the route. The communication dead zone encompasses the starting location for the trip. The communication dead zone has unreliable communication. In an aspect, the method further includes identifying the communication dead zone. The communication dead zone is identified by monitoring signal quality and strength of wireless transmissions while moving along the route and tracking the movement. The communication dead zone is an area along the route where monitored signal quality and strength are below a designated threshold.

In an embodiment, a method includes identifying a vehicle traveling on a route entering a pre-load zone. The pre-load zone defines an area of the route between at least two boundaries that is associated with reliable communication. The pre-load zone lies outside a communication dead zone that is associated with unreliable communication. The communication dead zone encompasses a starting location for a trip of the vehicle along the route. The method includes sending a trip request message to an off-board system from the vehicle after the vehicle enters the pre-load zone and before the vehicle enters the communication dead zone. The method also includes receiving a trip response message at the vehicle from the off-board system before the vehicle enters the communication dead zone. The trip response message includes trip data specific to the trip that starts at the starting location in the communication dead zone. The method includes storing the trip data on a memory device disposed on the vehicle. Upon receiving a trip initialization request, the method further includes retrieving the trip data from the memory device and controlling movements of the vehicle beyond the starting location of the trip based on the trip data.

In an aspect, if no trip initialization request is received before the vehicle at least one of exits the communication dead zone or crosses one of the boundaries of the pre-load zone to exit a portion of the pre-load zone that the vehicle is configured to traverse after exiting the communication dead zone, the method further comprises removing the trip data from the memory device.

In an aspect, the method further includes storing the locations of the boundaries of the pre-load zone in at least one of the memory device or another electronic storage device disposed on the vehicle. The method includes tracking the vehicle as the vehicle travels on the route to determine when the vehicle crosses one of the boundaries to enter the pre-load zone.

In an aspect, the trip request message being sent from the vehicle and the trip response message being received at the vehicle both occur after the vehicle crosses one of the boundaries to enter the pre-load zone and before the vehicle enters the communication dead zone.

In an aspect, the trip request message identifies the pre-load zone in which the vehicle is traveling. The trip data in the trip response message is selected by matching the pre-load zone identified in the trip request message to the trip based on a pre-determined association between the pre-load zone and the trip.

In an aspect, the trip request message identifies an upcoming station that the vehicle is approaching. The trip data in the trip response message is selected by matching the station identified in the trip request message to the trip based on a pre-determined association between the station and the trip. The pre-determined association between the station and the trip may be contained in a trip reference table. The trip reference table lists multiple trips along the route and identifies corresponding stations associated with the multiple trips.

In an aspect, the method further includes processing the trip data received in the trip response message and generating a trip plan based on the trip data. The trip plan specifies tractive and braking settings to be provided by the vehicle during the trip that starts within the communication dead zone as a function of location of the vehicle along an upcoming segment of the route.

In an aspect, the pre-load zone extends a first length between a first boundary of the pre-load zone and the first end of the communication dead zone and a second length between a second boundary of the pre-load zone and the second end of the communication dead zone. The first and second boundaries are selected such that the corresponding first and second lengths of the pre-load zone are each longer than a distance traversed by the vehicle in the time required for successful transmission of both the trip request message from the vehicle and the trip response message to the vehicle.

In an aspect, the vehicle is at least one of a rail vehicle, an automobile, a truck, an aerial vehicle, or a marine vessel.

In an aspect, the vehicle is a first vehicle that is at least one of mechanically or logically linked to a second vehicle such that movements of the first vehicle along the route are coordinated with movements of the second vehicle along the route.

In an embodiment, a system includes a communication system, a memory device, and an energy management system. The communication system is configured to be disposed onboard a vehicle traveling on a route that has a defined pre-load zone associated with reliable communication. The pre-load zone lies outside of a communication dead zone associated with unreliable communication. The communication dead zone encompasses a starting location for a trip of the vehicle along the route. The communication system is configured to send a trip request message to an off-board system after the vehicle enters the pre-load zone and before the vehicle enters the communication dead zone. The trip request message identifies the pre-load zone. The communication system is further configured to receive a trip response message from the off-board system before the vehicle enters the communication dead zone. The trip response message is responsive to the trip request message and includes trip data specific to the trip that starts in the communication dead zone. The trip is identified based on the identification of the pre-load zone in the trip request message. The memory device is configured to be disposed onboard the vehicle. The memory device is configured to store the trip data received from the off-board system. The energy management system is configured to be disposed onboard the vehicle. The energy management system is configured to retrieve the trip data from the memory device and control movement of the vehicle, based on the trip data, after the vehicle reaches the starting location of the trip.

In an aspect, locations of boundaries of the pre-load zone are stored in at least one of the memory device or the energy management system. The system further includes a location determining device configured to track movement of the vehicle and communicate current locations of the vehicle to the energy management system. The energy management system is configured to retrieve the locations of the boundaries of the pre-load zone that are stored to determine when the vehicle crosses one of the boundaries to enter the pre-load zone and crosses another of the boundaries to exit the pre-load zone.

In an aspect, the trip request message to the off-board system includes a pre-load zone identifier that identifies the pre-load zone through which the vehicle is traveling. The trip request message does not include geographic coordinates of the vehicle.

In an aspect, the pre-load zone extends a length along the route between a boundary of the pre-load zone and an end of the communication dead zone. A location of the boundary of the pre-load zone is selected such that the length of the pre-load zone is longer than a distance traversed by the vehicle in the time required for the communication system to both send the trip request message and receive the trip response message in response to the trip request message.

In an aspect, the communication system is configured to both send the trip request message and receive the trip response message after the vehicle enters the pre-load zone and before the vehicle enters the communication dead zone.

In an aspect, the energy management system is configured to retrieve the trip data from the memory device at least one of in response to a received request to initialize a trip while the vehicle is within the pre-load zone or automatically after the vehicle reaches the starting location of the trip.

In an aspect, the energy management system is configured to retrieve the trip data from the memory device upon receipt of a trip initialization request. If the energy management system has not received the trip initialization request upon the vehicle crossing a boundary exiting a portion of the pre-load zone that the vehicle traverses after exiting the communication dead zone, the trip data is removed from the memory device.

In an aspect, the pre-load zone extends a first length along the route between a first boundary of the pre-load zone and a first end of the communication dead zone. The pre-load zone further extends a second length along the route between a second end of the communication dead zone and a second boundary of the pre-load zone. The communication dead zone is disposed between the first and second lengths of the pre-load zone.

In an aspect, the energy management system may be configured to process the trip data to generate a trip plan that specifies tractive and braking settings to be provided by the vehicle during the trip that starts within the communication dead zone as a function of location of the vehicle along an upcoming segment of the route.

Embodiments are characterized herein in regards to a communication dead zone having ends. Ends refer to portions of a boundary of the communication dead zone; the portions may be oriented at a non-zero angle with respect to one another, and/or they may be parallel but spaced apart from one another, but do not have to be parallel.

Embodiments are also characterized in regards to a communication dead zone, which is an area associated with unreliable communication, whereas an area outside the communication dead zone (e.g., a pre-load zone that may be contiguous with the communication dead zone or that may be non-contiguous with the communication dead zone) is associated with reliable communication. Reliable communication and unreliable communication refer to one or more of the following: (i) relative communication qualities, e.g., an area associated with unreliable communication has poorer communication quality than an area associated with reliable communication, and the area with reliable communication has better communication quality than the area with unreliable communication; and/or (ii) an area associated with unreliable communication fails to meet one or more designated conditions, criteria, standards, etc. for communications throughput (e.g., monitored signal quality and strength are below a designated threshold), whereas an area associated with reliable communications does meet the one or more designated conditions, criteria, standards, etc. As one example of the latter, in an area associated with unreliable communication, wireless devices cannot transmit and/or receive data above a designated bandwidth, wherein in an area associated with reliable communication, wireless devices are able to transmit and/or receive data above the designated bandwidth (thereby, the designated bandwidth is the designated criterion). It should be noted that communication "dead" zone does not necessarily mean no communications are possible, although that is one possibility.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims. The various embodiments are not limited to the arrangements and instrumentality shown in the drawings.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A method comprising:

receiving a trip request message from a vehicle during travel of the vehicle in a defined pre-load zone along a route, the pre-load zone being associated with reliable communication of vehicles traveling through the pre-load zone, the vehicle configured to complete travel through the pre-load zone prior to reaching a starting location of a trip along the route, the pre-load zone being separated from the starting location of the trip along the route by a communication dead zone that is associated with unreliable communication of vehicles traveling through the communication dead zone, the trip request message identifying the pre-load zone; and sending a trip response message to the vehicle responsive to receiving the trip request message, the trip response message being sent such that the vehicle receives the trip response message prior to the vehicle completing travel through the pre-load zone and entering the communication dead zone, the trip response message including trip data specific to the trip that starts at the starting location outside of the pre-load zone.

2. The method of claim 1, wherein the pre-load zone extends a length along the route between first and second boundaries, the first and second boundaries being selected such that the length of the pre-load zone is longer than a distance traversed by the vehicle in the time required for successful transmission of both the trip request message from the vehicle and the trip response message to the vehicle.

3. The method of claim 1, wherein the trip data of the trip response message is selected based on an association between the pre-load zone that is identified in the trip request message and the trip, the association being contained in a trip reference table that lists multiple trips along the route and identifies corresponding pre-load zones associated with the trips.

4. The method of claim 1, wherein the trip data is a trip plan that specifies tractive and braking settings to be provided by the vehicle during the trip as a function of location of the vehicle along the route.

5. The method of claim 1, wherein the trip data includes at least one of vehicle makeup information, trip starting and ending locations, speed restrictions, work zone information, curvature and grade of the route information, or weather information that is specific to the trip.

6. The method of claim 1, wherein the starting location for the trip is a crew change station.

7. The method of claim 1, wherein the communication dead zone encompasses the starting location for the trip such that the vehicle traverses through the communication dead zone both prior to reaching the starting location of the trip and during at least a portion of the trip beyond the starting location.

8. The method of claim 1, wherein the pre-load zone is an area along the route where monitored signal quality and strength of wireless transmissions from vehicles traveling through the area are above a designated threshold, the communication dead zone being an area along the route where monitored signal quality and strength of wireless transmissions from vehicles traveling through the area are below the designated threshold.

9. A method comprising:

determining that a vehicle traveling on a route enters a pre-load zone, the pre-load zone defining an area of the route between at least two boundaries that is associated with reliable communication, the pre-load zone lying outside a communication dead zone that is associated with unreliable communication, the communication dead zone being disposed between the pre-load zone and a starting location for a trip of the vehicle along the route such that the vehicle traveling toward the starting location traverses through the pre-load zone prior to traversing through the communication dead zone;

sending a trip request message to an off-board system from the vehicle after the vehicle enters the pre-load zone and before the vehicle enters the communication dead zone;

receiving a trip response message at the vehicle from the off-board system before the vehicle enters the communication dead zone, the trip response message including trip data specific to the trip that starts at the starting location;

storing the trip data on a memory device disposed on the vehicle; and upon receiving a trip initialization request, retrieving the trip data from the memory device and controlling movements of the vehicle beyond the starting location of the trip based on the trip data.

10. The method of claim 9, wherein, if no trip initialization request is received before the vehicle at least one of exits the communication dead zone or crosses one of the boundaries of the pre-load zone to exit a portion of the pre-load zone that the vehicle is configured to traverse after exiting the communication dead zone, the method further comprises removing the trip data from the memory device.

11. The method of claim 9, further comprising storing the locations of the boundaries of the pre-load zone in at least one of the memory device or another electronic storage device disposed on the vehicle, and tracking the vehicle as the vehicle travels on the route to determine when the vehicle crosses one of the boundaries to enter the pre-load zone.

12. The method of claim 9, wherein the trip request message being sent from the vehicle and the trip response message being received at the vehicle both occur after the vehicle crosses one of the boundaries to enter the pre-load zone and before the vehicle enters the communication dead zone.

13. The method of claim 9, wherein the trip request message identifies the pre-load zone in which the vehicle is traveling, and the trip data in the trip response message is selected by matching the pre-load zone identified in the trip request message to the trip based on a pre-determined association between the pre-load zone and the trip.

14. The method of claim 9, wherein the trip request message identifies an upcoming station that the vehicle is approaching, and the trip data in the trip response message is selected by matching the station identified in the trip request message to the trip based on a pre-determined association between the station and the trip.

15. The method of claim 9, further comprising processing the trip data received in the trip response message and generating a trip plan based on the trip data, the trip plan specifying tractive and braking settings to be provided by the vehicle during the trip that starts at the starting location as a function of location of the vehicle along an upcoming segment of the route.

16. A system comprising:

a communication system configured to be disposed onboard a vehicle traveling on a route that has a defined pre-load zone associated with reliable communication and a defined communication dead zone associated with unreliable communication, the communication dead zone being adjacent to the pre-load zone and disposed between the pre-load zone and a starting location for a trip of the vehicle along the route, the communication system configured to send a trip request message to an off-board system after the vehicle enters the pre-load zone and before the vehicle enters the communication dead zone, the trip request message identifying the pre-load zone, the communication system further configured to receive a trip response message from the off-board system before the vehicle enters the communication dead zone, the trip response message being responsive to the trip request message and including trip data specific to the trip that starts at the starting location, the trip being identified based on the identification of the pre-load zone in the trip request message;

a memory device configured to be disposed onboard the vehicle, the memory device configured to store the trip data received from the off-board system; and an energy management system configured to be disposed onboard the vehicle, the energy management system configured to retrieve the trip data from the memory device and control movement of the vehicle, based on the trip data, after the vehicle reaches the starting location of the trip.

17. The system of claim 16, wherein locations of boundaries of the pre-load zone are stored in at least one of the memory device or the energy management system, the system further comprising a location determining device configured to track movement of the vehicle and communicate current locations of the vehicle to the energy management system, the energy management system configured to retrieve the locations of the boundaries of the pre-load zone that are stored to determine when the vehicle crosses one of the boundaries to enter the pre-load zone and crosses another of the boundaries to exit the pre-load zone.

18. The system of claim 16, wherein the trip request message to the off-board system includes a pre-load zone identifier that identifies the pre-load zone through which the vehicle is traveling, the trip request message not including geographic coordinates of the vehicle.

19. The system of claim 16, wherein the pre-load zone extends a length along the route between a boundary of the pre-load zone and an end of the communication dead zone, a location of the boundary of the pre-load zone being selected such that the length of the pre-load zone is longer than a distance traversed by the vehicle in the time required for the communication system to both send the trip request message and receive the trip response message in response to the trip request message.

20. The system of claim 16, wherein the communication system is configured to not send the trip request message to the off-board system and to not receive the trip response message from the off-board system while the vehicle traverses through the communication dead zone.

* * * * *